US011198450B2

(12) United States Patent
Mathis et al.

(10) Patent No.: US 11,198,450 B2
(45) Date of Patent: Dec. 14, 2021

(54) METHOD FOR OPERATING A CABLE CAR SYSTEM AND CABLE CAR SYSTEM FOR CARRYING OUT THIS OPERATING METHOD

(71) Applicant: ROPETRANS AG, Rotkreuz (CH)

(72) Inventors: Michael Mathis, Hoechst (AT); Peter Luger, Dornbirn (AT); Michael Hofer, Sulzberg (AT); Iwan Bissig, Schattdorf (CH)

(73) Assignee: Ropetrans AG, Rotkreuz (CH)

( * ) Notice: Subject to any disclaimer, the term of this patent is extended or adjusted under 35 U.S.C. 154(b) by 337 days.

(21) Appl. No.: 16/468,918

(22) PCT Filed: Dec. 5, 2017

(86) PCT No.: PCT/EP2017/081568
§ 371 (c)(1),
(2) Date: Jun. 12, 2019

(87) PCT Pub. No.: WO2018/108636
PCT Pub. Date: Jun. 21, 2018

(65) Prior Publication Data

US 2020/0094854 A1 Mar. 26, 2020

(30) Foreign Application Priority Data

Dec. 12, 2016 (AT) ..... A 560/2016

(51) Int. Cl.
*B61B 12/10* (2006.01)
*B61B 7/04* (2006.01)
(Continued)

(52) U.S. Cl.
CPC ..... *B61B 12/10* (2013.01); *B61B 7/04* (2013.01); *B61B 12/02* (2013.01); *B61B 12/06* (2013.01)

(58) Field of Classification Search
CPC ..... B61B 7/04; B61B 12/02; B61B 12/06; B61B 12/10
See application file for complete search history.

(56) References Cited

U.S. PATENT DOCUMENTS 5,528,219 A * 6/1996 Frohlich ..... B61B 12/06 104/178
5,626,078 A * 5/1997 Fuchs ..... B61B 12/022 104/28
(Continued)

FOREIGN PATENT DOCUMENTS

AT 411982 B 8/2004
EP 0736434 A2 10/1996
(Continued)

*Primary Examiner* — Jason C Smith
(74) *Attorney, Agent, or Firm* — Laurence A. Greenberg; Werner H. Stemer; Ralph E. Locher

(57) ABSTRACT

A cable car system has at least two cable car stations and at least one carrying cable between the stations. A cable car vehicle is moved by a hauling cable between the car stations. The travelling positions of the vehicle along the travelling route are determined by a measuring device and transmitted to a control unit and processed and stored in same. A signal is input into the control unit by an input device located on a cable car support such that maintenance or assembly works and similar are carried out on this cable car support. When a cable car vehicle approaches the cable car support, the drive for moving the at least one cable car vehicle is controlled by the control unit such that the cable car vehicle is moved at a significantly reduced speed in relation to the operating speed, or is stopped at the cable car support.

8 Claims, 2 Drawing Sheets

(51) Int. Cl.
*B61B 12/02* (2006.01)
*B61B 12/06* (2006.01)

(56) References Cited

U.S. PATENT DOCUMENTS

| | | | | |
|---|---|---|---|---|
| 6,393,995 | B1 * | 5/2002 | Mugnier | B61B 7/04 104/112 |
| 9,688,289 | B2 * | 6/2017 | Luger | B61B 7/02 |
| 9,873,439 | B2 * | 1/2018 | Moritzhuber | B61B 12/00 |
| 10,414,418 | B2 * | 9/2019 | Martin | B61B 1/02 |
| 2007/0034105 | A1 * | 2/2007 | Mugnier | B61B 12/105 104/178 |
| 2009/0151594 | A1 * | 6/2009 | Dur | B61B 12/026 104/112 |
| 2010/0018434 | A1 * | 1/2010 | Moritzhuber | B61B 12/06 104/178 |
| 2015/0075403 | A1 * | 3/2015 | Moritzhuber | B61B 7/02 104/28 |
| 2018/0048156 | A1 * | 2/2018 | Luger | H02M 7/02 |
| 2020/0094854 | A1 * | 3/2020 | Mathis | B61B 12/10 |

FOREIGN PATENT DOCUMENTS

| | | | |
|---|---|---|---|
| EP | 2072367 | A1 | 6/2009 |
| EP | 2848489 | A1 | 3/2015 |
| EP | 2977286 | A1 | 1/2016 |
| JP | 02057463 | A | 2/1990 |
| JP | H07108931 | A | 4/1995 |
| JP | 2005041379 | A | 2/2005 |
| JP | 2007069861 | A | 3/2007 |
| KR | 1020120057683 | A | 6/2012 |
| RU | 2163204 | C2 | 2/2001 |
| RU | 2481212 | C2 | 5/2013 |
| WO | 9530216 | A1 | 11/1995 |
| WO | 2015077806 | A1 | 6/2015 |
| WO | 2016145463 | A1 | 9/2016 |

* cited by examiner

METHOD FOR OPERATING A CABLE CAR SYSTEM AND CABLE CAR SYSTEM FOR CARRYING OUT THIS OPERATING METHOD

BACKGROUND OF THE INVENTION

Field of the Invention

The objective invention relates to a method for operating a cable car system having at least two cable car stations and having at least one haul cable which runs between the cable car stations, is self-contained, and to which at least one cable car vehicle is coupled, or having at least one suspension cable, on which at least one cable car vehicle is moved by means of at least one traction cable, the at least one cable car vehicle being moved between the cable car stations by means of the haul cable or the traction cable, and having at least one cable car support, over which the haul cable or the suspension cable and the traction cable are guided. Furthermore, the objective invention relates to a cable car system for carrying out said operating method.

Such a method for operating a cable car system and such a cable car system are known, for example, from AT 411 982 B.

There is the requirement in the case of cable car systems to perform maintenance or repair work in the course of the movement path of the cable car vehicles, said work often also taking place during the operation of the cable car systems. There is thus the requirement, in particular in the case of cable car systems with suspension cables, on which the cable car vehicles are moved by means of traction cables, to supply the plain bearings, situated on the suspension supports, for the suspension cables with lubricants during the operation. In the case of maintenance or repair work of this type, the operating personnel who perform said work and who are situated close to or in the moving regions of the cable car vehicles are exposed to great dangers on account of the cable car vehicles.

SUMMARY OF THE INVENTION

The objective invention is based on the object of providing an operating method, by way of which said hazard is reduced significantly. According to the invention, this is achieved by virtue of the fact that the moving positions of the at least one cable car vehicle along the transport paths are determined by means of at least one measuring device, that the moving positions of the at least one cable car vehicle along the transport paths are transmitted to a control unit and are processed and stored in the latter, and that a signal is input into the control unit by means of an input unit which is situated on the at least one cable car support, notifying that maintenance or assembly work and the like is being performed on said cable car support, the drive for the movement of the at least one cable car vehicle being regulated by way of the control unit in the case of the approach of a cable car vehicle to the cable car support, in such a way that the cable car vehicle is moved at a speed which is greatly reduced in comparison with the operating speed or is stopped in the region of the cable car support.

In the case of a cable car system for carrying out said operating method, having at least two cable car stations and having at least one haul cable which runs between said cable car stations, is self-contained, and to which at least one cable car vehicle is coupled, or having at least one suspension cable, on which at least one cable car vehicle is moved by means of at least one traction cable, the at least one cable car vehicle being moved between the cable car stations by means of the haul cable or the traction cable, and having at least one cable car support, over which the haul cable or the suspension cable and the traction cable are guided, a measuring device is provided according to the invention, by means of which the moving positions of the at least one cable car vehicle along the transport paths can be determined, and, furthermore, a control unit is provided, to which the moving positions of the at least one cable car vehicle along the transport paths can be transmitted, and can be processed and stored in said control unit, and an input unit is provided on the at least one cable car support, by way of which input unit a signal can be input into the control unit, notifying that maintenance or assembly work and the like is being performed on said cable car support, it being possible for the drive for the movement of the at least one cable car vehicle to be regulated by way of the control unit in the case of the approach of a cable car vehicle to the cable car support, in such a way that said cable car vehicle is moved at a speed which is greatly reduced in comparison with the operating speed or is stopped in the region of the cable car support.

The at least one cable car vehicle is preferably configured with a visual and/or acoustic signal generator which is set in operation by way of the control unit as soon as the cable car vehicle approaches the cable car support. Furthermore, the device for determining the moving positions of the at least one cable car vehicle is formed by way of at least one measuring device which is situated in one of the cable car stations.

BRIEF DESCRIPTION OF THE SEVERAL VIEWS OF THE DRAWING

In the following text, the operating method according to the invention and a cable car system for carrying out said method will be described in greater detail using one exemplary embodiment which is shown in the drawing, in which.

DESCRIPTION OF THE INVENTION

Figure 1:
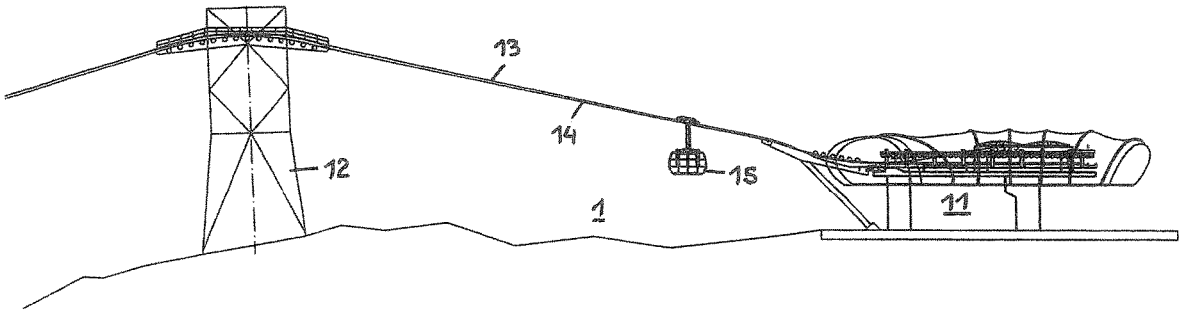
FIG. 1 shows a section of a cable car system having a cable car station, a cable car support and a cable car vehicle which can be moved on a suspension cable by means of a traction cable.

FIG. 1 shows a section of a cable car system 1 having a cable car station 11 and having a cable car support 12. A suspension cable 13 is situated between the cable car station 11 and a further cable car station (not shown), which suspension cable 13 is anchored in the cable car stations and is guided over the cable car support 12. Cable car vehicles 15 can be moved on the suspension cable 13 by means of a traction cable 14. The traction cable 14 which is self-contained and is guided in the cable car stations via cable diversion pulleys and cable deflection pulleys is moved in a circulating manner at a speed of, for example, 7 m/s. In the cable car stations, the cable car vehicles 15 are decoupled from the traction cable 14, are moved through the relevant cable car station, said cable car vehicles 15 being entered and exited by the passengers, and are subsequently coupled to the traction cable 14 again, whereupon they are moved to the other cable car station. Instead of a suspension cable and a traction cable, a haul cable can be provided, to which cable car vehicles 15 are coupled.

In order to ensure operation of said cable car system, which operation corresponds to the technical requirements, firstly the movement speeds of the at least one traction cable 14 or the at least one haul cable and therefore the moving speeds of the cable car vehicles 15 and secondly the moving positions of the cable car vehicles 15 are determined and stored at each point of the operation.

Figure 2:
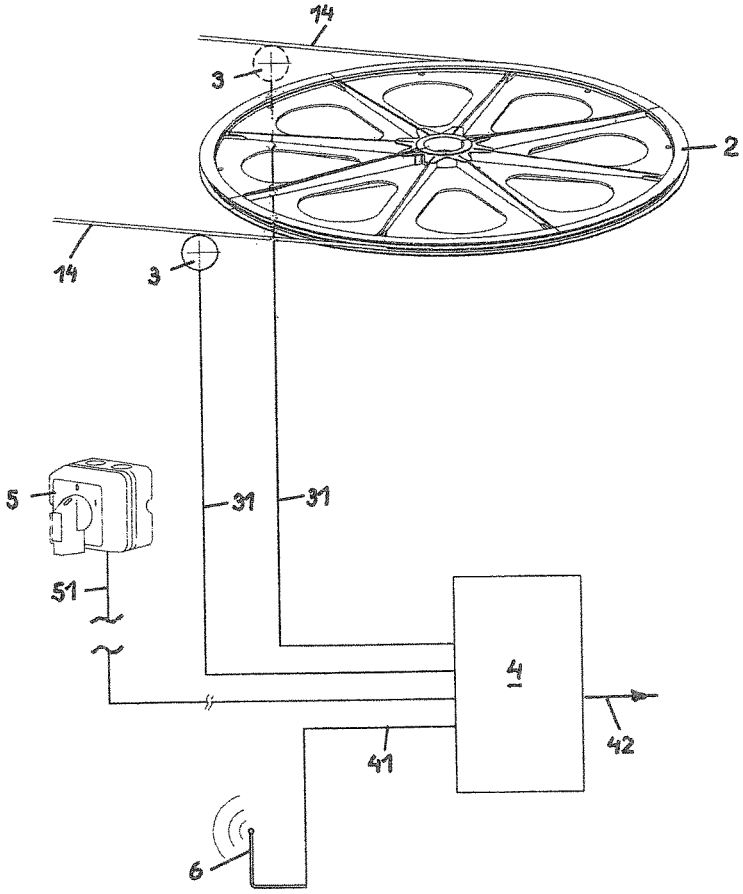
FIG. 2 shows a deflection pulley for the traction cable, in an axonometric illustration, and a block circuit diagram having a control unit.

As shown in FIG. 2, the traction cable 14 is guided around a cable deflection pulley 2 in the cable car station 11. Since the traction cable 14 is likewise guided around a deflection pulley in the other cable car station, it can be moved in a circulating manner. The traction cable 14 is assigned at least one measuring device 3, by way of which the respective speeds of the traction cable 14 and its movement lengths are measured. As a result, the moving positions of the cable car vehicles 15 which are coupled to the traction cable 14 and therefore their distances from the cable car station 11 or from the cable car support 12 can be determined at any time.

Furthermore, a control unit 4 is provided for controlling the cable car system, into which control unit 4 the data, obtained by way of the measuring device 3, of the movement sequences are input via lines 31, and in which control unit 4 they are processed and stored. Input units 5 are provided in those regions of the cable car system, in which maintenance or assembly work has to be performed, for example on the cable car support 12, by way of which input units 5 that region, in which maintenance or repair work is being performed, can be input via a line 51 or via radio into the control unit 4. Furthermore, a transmitting unit 6 is provided which is operated by the control unit 4 via a line 41.

Figure 3:
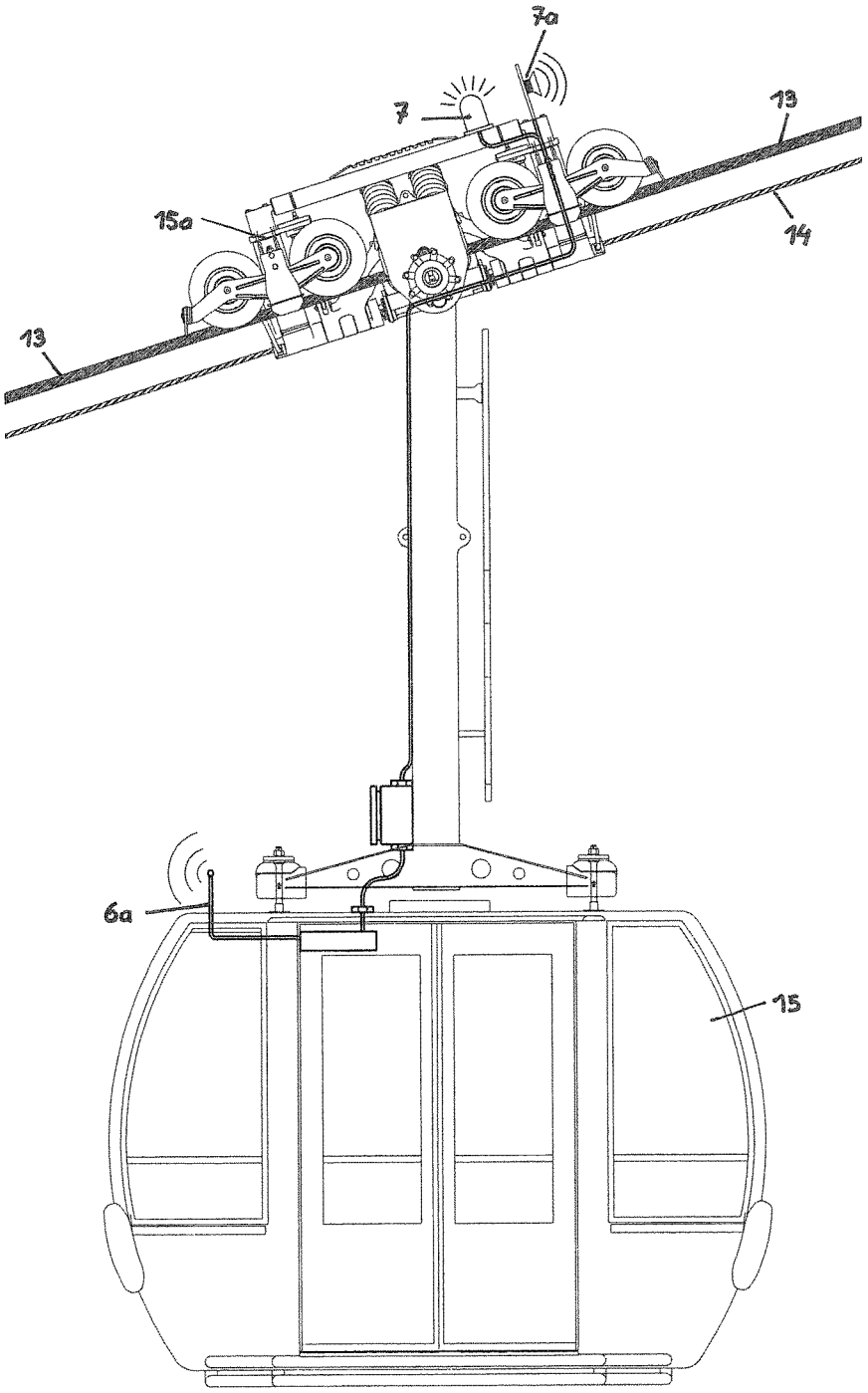
FIG. 3 shows a cable car vehicle which can be moved in the cable car system, in a side view.

As shown in FIG. 3, furthermore, a receiving unit 6*a* is situated on the cable car vehicle 15, and a warning light 7 and/or an acoustic warning unit 7*a* which are/is set in operation by the control unit 4 via the transmitting unit 6 and the receiving unit 6*a* are/is situated on the chassis 15*a* of the cable car vehicle 15.

As soon as maintenance or repair work is being performed on a cable car support 12, a signal is input by way of the input unit 5 via the line 51 to the control unit 4, which signal identifies the relevant cable car support 12. With the use of those measurement data which are input by way of the measuring units 3 via the lines 31 into the control unit 4, a signal is then output via the transmitting unit 6 and the receiving unit 6*a* to the cable car vehicle 15 when a cable car vehicle 15 approaches said cable car support 12, which signal triggers the warning light 7 and/or the acoustic warning unit 7*a*. As a result, the operating personnel who are situated on said cable car support 12 are alerted that a cable car vehicle 15 is approaching. In addition, a control signal is output by the control unit 4 via a line 42 to the drive for the traction cable 14, by way of which control signal the movement speed of the traction cable 14 is reduced greatly. As soon as the cable car vehicle 15 has been moved past the cable car support 12, the speed of the traction cable 14 is brought to the operating speed again. In an analogous way, in the case of an approach of the cable car vehicle 15 to the cable car support 12, the drive for the traction cable 14 can be switched off by way of the control unit 4. As soon as the operating personnel are brought to safety, the drive for the traction cable 14 is switched on again, the cable car vehicle 15 is moved past the cable car support 12, and the operating speed is assumed again.

Said operating method and said cable car system ensure an optimum protection of the operating personnel when carrying out maintenance or repair work.

The invention claimed is:

1. A method of operating a cable car system having at least two cable car stations, a cable running between the cable car stations, at least one cable car vehicle moving along a transport path between the cable car stations, and at least one cable car support between the cable car stations for supporting the cable, the method comprising:

determining respective moving positions of the at least one cable car vehicle along the transport path with at least one measuring device;

transmitting the moving positions of the at least one cable car vehicle along the transport path to a control unit and processing and storing the moving positions in the control unit;

notifying that maintenance or assembly work is being performed on the at least one cable car support by transmitting a corresponding signal from an input unit situated on the at least one cable car support to the control unit;

controlling a drive for moving the at least one cable car vehicle by way of the control unit when the cable car vehicle approaches the at least one cable car support, to cause the cable car vehicle to move at a speed that is greatly reduced in comparison with an operating speed or is stopped in a region of the cable car support.

2. The method according to claim 1, wherein the cable is a self-contained haul cable which runs between the cable car stations and which hauls the at least one cable car vehicle that is coupled thereto and that is supported on at least one suspension cable.

3. The method according to claim 1, wherein the cable is a self-contained traction cable onto which the at least one cable car vehicle is clamped and which moves the at least one cable car vehicle between the cable car stations.

4. A cable car system, comprising:

at least two cable car stations;

at least one self-contained haul cable extending between said cable car stations and having said at least one cable car vehicle coupled thereto, or at least one suspension cable, on which at least one cable car vehicle is moved by way of at least one traction cable, wherein the at least one cable car vehicle is moved along a transport path between said cable car stations by way said haul cable or said traction cable;

at least one cable car support, over which said haul cable or said suspension cable and said traction cable are guided;

a measuring device configured to determine moving positions of said at least one cable car vehicle along the transport path;

a control unit configured to receive, process and store the moving positions of said at least one cable car vehicle along the transport path; and an input unit disposed at said at least one cable car support, said input unit enabling an input signal to be conveyed to said control unit, notifying that maintenance or assembly work is being performed on said cable car support, wherein said control unit controls a drive for the movement of said at least one cable car vehicle such that, upon an approach of said at least one cable car vehicle to said cable car support, said cable car vehicle is moved at a speed which is greatly reduced relative to a regular operating speed or is stopped in a region of said cable car support.

5. The cable car system according to claim 4, configured for carrying out the following operating method, determining respective moving positions of the at least one cable car vehicle along the transport path with said measuring device;

transmitting the moving positions of the at least one cable car vehicle along the transport path to said control unit and processing and storing the moving positions in said control unit;

notifying that maintenance or assembly work is being performed on the at least one cable car support by transmitting a corresponding signal from said input unit to said control unit;

controlling the drive for moving the at least one cable car vehicle by way of the control unit when the cable car vehicle approaches said cable car support, to cause the cable car vehicle to move at a speed that is greatly reduced in comparison with an operating speed or is stopped in a region of said cable car support.

6. The cable car system according to claim 4, wherein said at least one cable car vehicle is equipped with a signal generator to be set in operation by way of said control unit as soon as said cable car vehicle approaches said cable car support.

7. The cable car system according to claim 6, wherein said signal generator is a visual and/or acoustic signaling device.

8. The cable car system according to claim 6, wherein said measuring device for determining the moving positions of said at least one cable car vehicle is at least one measuring device disposed in one of said cable car stations.

* * * * *